US008375759B2

(12) United States Patent
Sanginiti et al.

(10) Patent No.: US 8,375,759 B2
(45) Date of Patent: Feb. 19, 2013

(54) BRIDGE TURRET TRANSFER ASSEMBLY

(75) Inventors: William J. Sanginiti, Philadelphia, PA (US); Roger Witt, Philadelphia, PA (US); Errol Hancock, Devon (CA); Robert Chaffer, Marietta, GA (US); Robert Rose, Batesville, MS (US)

(73) Assignee: Crown Packaging Technology, Inc., Alsip, IL (US)

( * ) Notice: Subject to any disclaimer, the term of this patent is extended or adjusted under 35 U.S.C. 154(b) by 792 days.

(21) Appl. No.: 12/254,232

(22) Filed: Oct. 20, 2008

(65) Prior Publication Data

US 2010/0095725 A1 Apr. 22, 2010

(51) Int. Cl.
*B21D 51/26* (2006.01)

(52) U.S. Cl. ..... 72/94; 72/405.03

(58) Field of Classification Search ..... 72/94, 405.03; 198/478.1, 860.2; 29/35.5–48.5 A
See application file for complete search history.

(56) References Cited

U.S. PATENT DOCUMENTS

| | | | | |
|---|---|---|---|---|
| 3,988,917 | A * | 11/1976 | Mykolenko | 72/187 |
| 5,611,231 | A | 3/1997 | Marritt et al. | |
| 6,085,563 | A * | 7/2000 | Heiberger et al. | 72/94 |
| 6,505,806 | B1 * | 1/2003 | Glaesener | 248/638 |
| 6,886,682 | B2 * | 5/2005 | Bowlin et al. | 198/583 |
| 2006/0101885 | A1 * | 5/2006 | Schill et al. | 72/94 |

* cited by examiner

*Primary Examiner* — Dana Ross
*Assistant Examiner* — Pradeep C Battula
(74) *Attorney, Agent, or Firm* — Woodcock Washburn LLP

(57) ABSTRACT

An apparatus for joining two fixed bases having a plurality of can necking stages, is provided. The apparatus minimizes space, and reduces the diameter of a can neck as it transfers a can body from a first fixed base to a second fixed base.

12 Claims, 4 Drawing Sheets

BRIDGE TURRET TRANSFER ASSEMBLY

FIELD OF THE TECHNOLOGY

The present technology relates to a multi-stage can necking machine. More particularly, the present technology relates to a bridge for connecting adjacent fixed base multi-stage can necking machines.

BACKGROUND

Metal beverage cans are designed and manufactured to withstand high internal pressure—typically 90 or 100 psi. Can bodies are commonly formed from a metal blank that is first drawn into a cup. The bottom of the cup is formed into a dome and a standing ring, and the sides of the cup are ironed to a desired can wall thickness and height. After the can is filled, a can end is placed onto the open can end and affixed with a seaming process.

It has been conventional practice to reduce the diameter at the top of the can to reduce the weight of the can end in a process referred to as necking. Cans may be necked in a "spin necking" process in which cans are rotated with rollers that reduce the diameter of the neck. Most cans are necked in a "die necking" process in which cans are longitudinally pushed into dies to gently reduce the neck diameter over several stages. For example, reducing the diameter of a can neck from a conventional body diameter of 2-$^{11}/_{16}{}^{th}$ inches to 2-$^{6}/_{16}{}^{th}$ inches (that is, from a 211 to a 206 size) often requires multiple stages.

For example, can manufacturing plants may need to combine two sections of can necking stages to reduce the neck of a can to a desired diameter. Typically, the two sections are combined with either a bridge transfer assembly or with a single base having a necking stage. Because floor space in a can manufacturing plant is limited, there is a need for effectively combining the two sections of can necking stages without unnecessarily wasting space.

Typical bridge transfer assemblies do not reduce the neck of the can as it transfers the can body from one section to the other. Accordingly, the space that the bridge transfer assembly occupies is not being used effectively, because it merely is passing the can body from one section of can necking stages to another without doing more.

Unlike the bridge transfer assembly, the single base having a necking stage reduces the end of the can body as it is passed from one section to the other. However, the single bases are large and bulky and often times take up an unnecessary amount of space.

SUMMARY

An apparatus for joining two fixed bases having a plurality of can necking stages, is provided. The apparatus minimizes space, and reduces the diameter of a can neck as it transfers a can body from a first fixed base to a second fixed base.

In one embodiment, a bridge turret transfer assembly may comprise a base, a shaft mounted on the base and a turret mounted on the shaft. The base may include a middle support, a pedestal extending down from the middle support, a first support extending from the middle support, and a second support extending from the middle support. The first support is configured to couple to a first fixed base of a multi-stage can necking system, and the second support is configured to couple to a second fixed base of a multi-stage can necking system. The turret is configured to reduce an end diameter of a can body.

When the bridge turret transfer assembly combines two fixed bases, a multi-stage can necking system is provide. In one embodiment, a multi-stage can necking system may comprise a first fixed base, a second fixed base and a bridge turret transfer assembly coupling the first fixed base and the second fixed base together. The first fixed base may comprise at least two can necking stages and a first transfer starwheel. The second fixed base may comprise at least one can necking stage and a second starwheel. The bridge turret transfer assembly may be configured to transfer a can body from the first fixed base to the second fixed base and may be configured to reduce an end diameter of the can body. A distance measured between the first starwheel of the first fixed base and a second starwheel of the second fixed base is no more than 27.25 in. Alternatively, a distance measured between a first edge of the first fixed base and a second edge of the second fixed base is no more than 27 in.

DETAILED DESCRIPTION OF ILLUSTRATIVE EMBODIMENTS

Example embodiments of a bridge turret transfer assembly configured to transfer can bodies between sections of can necking stages in a manufacturing process is described herein. The present invention is not limited to the disclosed configuration, but rather encompasses use of the technology disclosed in any container or can manufacturing application as defined by the appended claims.

Figure 1:
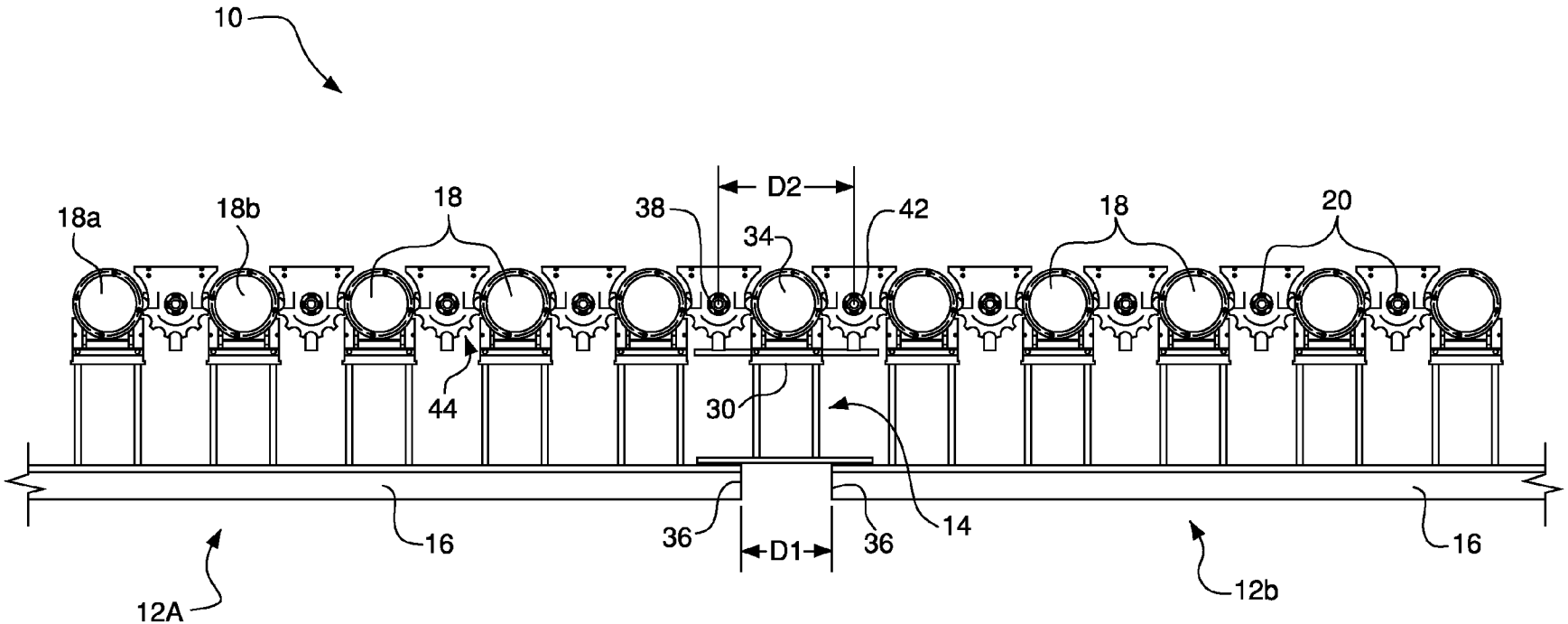
FIG. 1 is a schematic of a bridge turret transfer assembly connecting two fixed bases.

FIG. 1 is a schematic of a bridge turret transfer assembly combining two fixed bases of can necking stages. Referring to FIG. 1 to illustrate a preferred structure and function of the present invention, a multi-stage can necking system 10 includes two fixed bases (for example, a first fixed base 12*a* and a second fixed base 12*b*) and a bridge turret transfer assembly 14.

As shown in FIG. 1, each fixed base 12*a* and 12*b* includes a base 16, a plurality of necking stages 18, and a plurality of transfer starwheels 20. Each one of necking stages 18 is adapted to incrementally reduce the diameter of an open end of a can body, and transfer starwheels 20 are adapted to transfer the can body between adjacent necking stages 18, and optionally at the inlet and outlet of each fixed base 12*a* and 12*b*. Conventional multi-stage can necking systems, in general, include an input station and a waxer station at an inlet of the necking stages, and optionally include a bottom reforming station, a flanging station, and a light testing station positioned at an outlet of the necking stages. Accordingly, multi-stage can necking system 10, may include in addition to necking stages 18, other operation stages such as an input station, a bottom reforming station, a flanging station, and a light testing station as in conventional multi-stage can necking systems.

As shown in FIG. 1, bridge turret transfer assembly 14 includes a base 30 and a necking stage 34. Therefore, unlike typical bridge transfer assemblies which only transfer can bodies from one fixed base to another, bridge turret transfer assembly 14 reduces the diameter of the open end of the can bodies as the can bodies are transferred from one fixed base to another. As shown, the bridge turret transfer assembly is positioned between first fixed base 12*a* and second fixed base 12*b*. Therefore, each base 16 of fixed bases 12*a* and 12*b* may have a respective interior edge or end 36 that together define a gap having a distance D1 for bridge turret transfer assembly 14 to be positioned in. Distance D1 preferably is no more than 27 in. and no less than 15 in. Even more preferable, distance D1 is 19 in.

Furthermore, bridge turret transfer assembly 14 should be able to fit between fixed bases 12*a* and 12*b* such that a last transfer starwheel 38 of first fixed base 12*a* can pass off a can body to necking stage 34 of bridge turret transfer assembly 14, which in turn can pass the can body to a first transfer starwheel 42 of second fixed base 12*b*. Therefore, last transfer starwheel 38 should be separated from first transfer starwheel 42 by a distance D2. Distance D2 preferably is no more than 27.25 in. and no less than 26.75 in. Even more preferable, distance D2 is 27 in.

A can body may be passed through any number of can necking stages 18 depending on the desired diameter of the open end of the can body. For example, as shown in FIG. 1, multi-stage can necking system 10 includes eleven can necking stages (five can necking stages 18 in each fixed base 12*a* and 12*b*, and one can necking stage 34 on bridge turret transfer assembly 14. Although eleven can necking stages are shown in FIG. 1, any number of necking stages may be included in multi-stage can necking system 10, including 5, 10, 13, 14, 15, 17, and 20 can necking stages. Each can necking stage incrementally reduces the diameter of the open end of the can body as described above. Alternatively, some of necking stages 18 may be adapted to perform other operations of the can necking system, such as flanging or light testing.

Each transfer starwheel 20 may be mounted on a shaft, and may include several pockets 44 formed therein. Transfer starwheels 20 may have any amount of pockets 44. For example, each transfer starwheel 20 may include twelve pockets 44 or even eighteen pockets 44, depending on the particular application and goals of the machine design. Each pocket 44 is adapted to receive a can body and may retain the can body using a vacuum force. The vacuum force should be strong enough to retain the can body as transfer starwheel 20 carries the can body through an arc along a bottom of transfer starwheel 20.

Each transfer starwheel 20 may be associated with a respective necking of multi-stage can necking system 10, and is operable to transfer the can bodies from a first upstream necking stage 18, which has finished processing the can body, to a second downstream necking stage 18 for further processing. For instance, in the illustrated embodiment, after the diameter of the end of a can body has been reduced by a first can necking stage 18*a*, the first can necking stage 18*a* transfers the can body to a transfer starwheel 20 which, in turn, deposits the can body to an adjacent can necking stage 18*b*. The can necking stage 18*b* further reduces the diameter of the end of the can body in substantially the manner described above.

Referring now to FIGS. 2A-2D, base 30 of bridge turret transfer assembly 14 is depicted in more detail. As shown, base 30 of bridge turret transfer assembly 14 includes a middle support 48, wing supports 52, a first shaft support 56, a second shaft support 60, and a pedestal 64.

As shown, middle support 48 is mounted on top of pedestal 64 and is generally parallel to the surface on which bridge turret transfer assembly 14 is mounted. Each wing support 52 is also generally parallel to the mounting surface and may extend from opposing sides of middle support 48. As shown, a recess 68 is defined by middle support 48 and wing supports 52. Recess 68 should provide enough clearance for the tooling of necking stage 34 during operation. That is, recess 68 may serve as a routing channel or space for any hoses or wires that are typically routed underneath the tooling of necking stage 34 as the tooling rotates. To ensure that there is no interference, the depth of recess 68 preferably is no more than 2 in. and no less than 0.75 in., but it may be any depth that is sufficient to prevent contact between the hoses, wires and other tooling of necking stage 34 and middle support 48. Preferably recess 68 has a depth of 1⅜ in.

As shown, each wing support 52 defines a plurality of mounting holes 72 and includes an outer edge 76. Outer edges 76 should be separated by a distance D3. Distance D3 preferably is no more than 39.5 in. and no less than 27 in. Even more preferable, Distance D3 is 35.5 in.

Figure 2A:
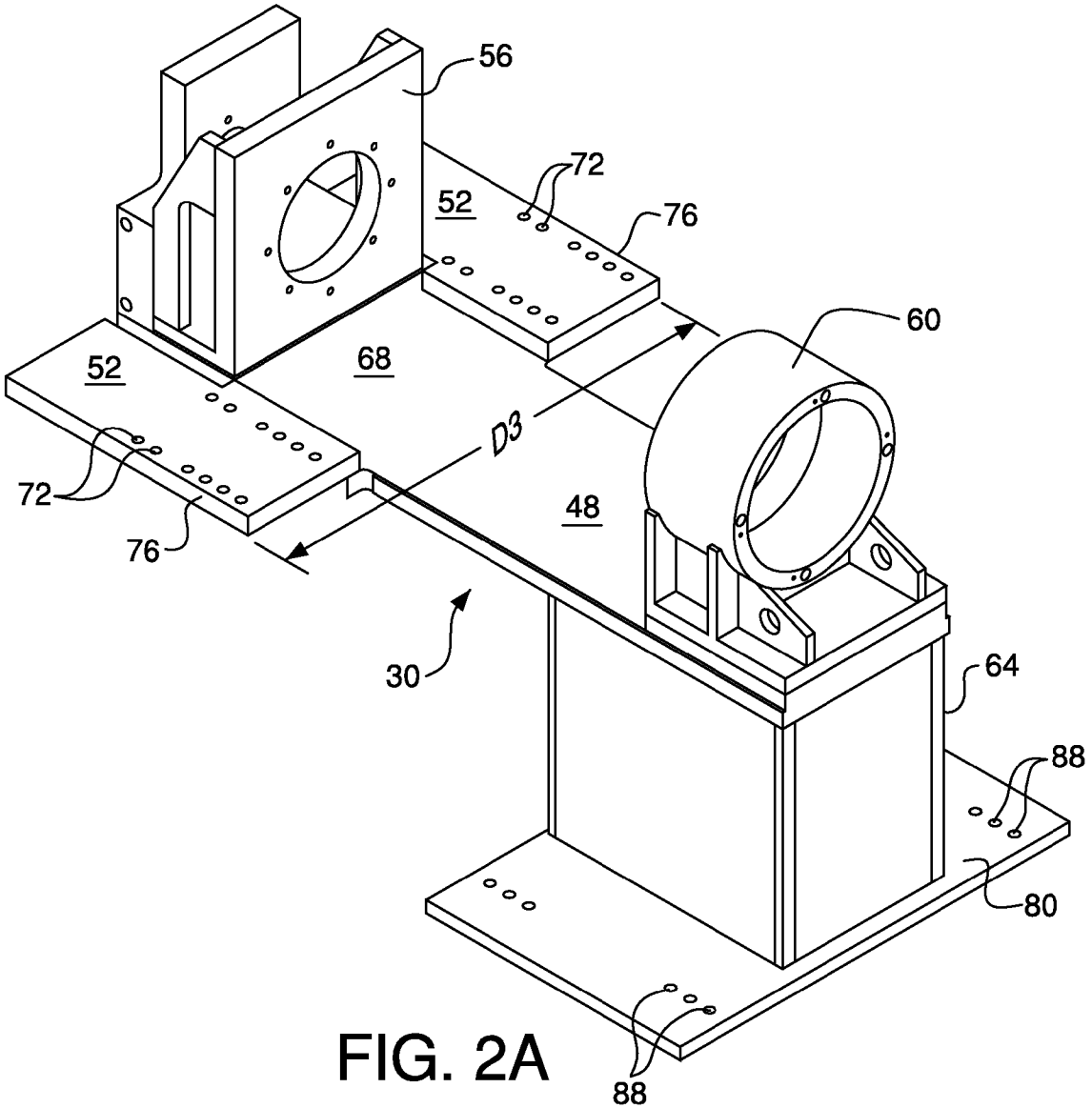
FIG. 2A is a perspective view depicting a bridge turret transfer assembly with the turret and shaft removed for clarity.
Figure 2C:
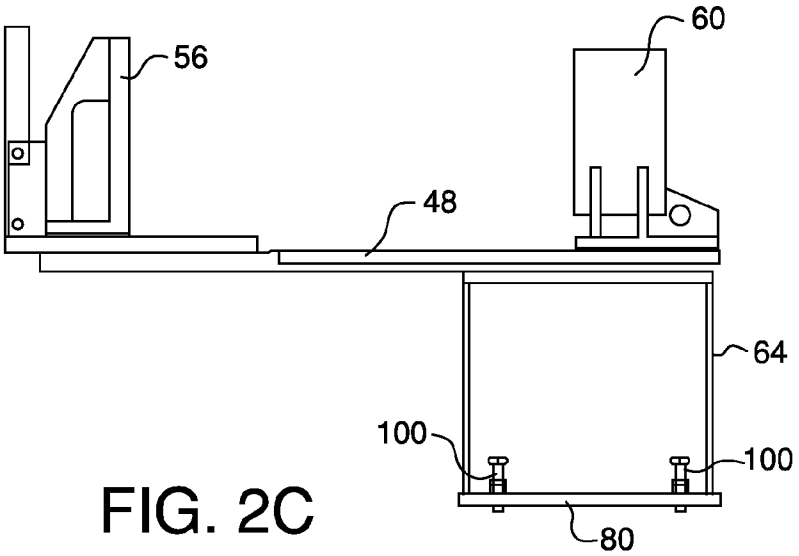
FIG. 2C is a side view thereof.

Referring to both FIGS. 1 and 2A, each wing support 52 may be adapted to support a transfer starwheel 20. As shown, each transfer starwheel 20 may be coupled to a respective wing support 52 using bolts, screws, rivets, or any other coupling mechanism known in the art in conjunction with mounting holes 72. In the embodiment shown in FIG. 2A, twelve mounting holes 72 are defined in each wing support 52, but in other embodiments, any number of mounting holes 72 may be defined, including two, three, six, ten, or sixteen. In addition to mounting starwheels 20 mounting holes 72 of wing supports 52 may be used to couple bridge turret transfer assembly 14 to fixed bases 12*a* and 12*b*.

Accordingly, as shown in FIG. 1, starwheel 38 that may be coupled to wing support 52 may receive a can body (not shown) from necking stage 18 of first fixed base 12*a*, and starwheel 42 that may be coupled to wing support 52 may deliver the can body to necking stage 18 of second fixed base 12*b*. While each can body is passing through bridge turret transfer assembly 14, necking stage34 may incrementally reduce the diameter of the open end of the can body as described above. In this way, bridge turret transfer assembly 14 may transfer a can body from first fixed base 12*a* to second fixed base 12*b*, while also performing an intermediate can necking process operation on the can body.

As shown, first shaft support 56 is mounted on a first end of middle support 48 between wing supports 52 and second shaft support 60 is mounted on a second opposite end of middle support 48. Together, first shaft support 56 and second shaft support 60 are capable of supporting a shaft.

Figure 2D:
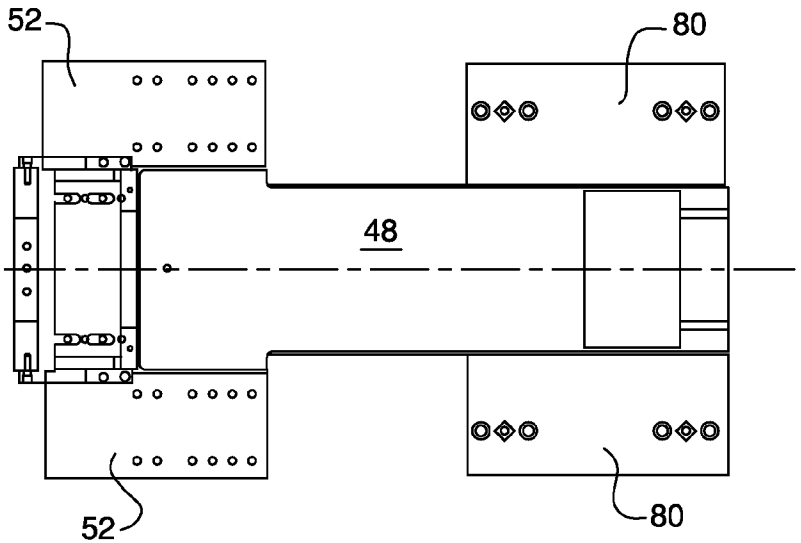
FIG. 2D is a top view thereof.
Figure 2B:
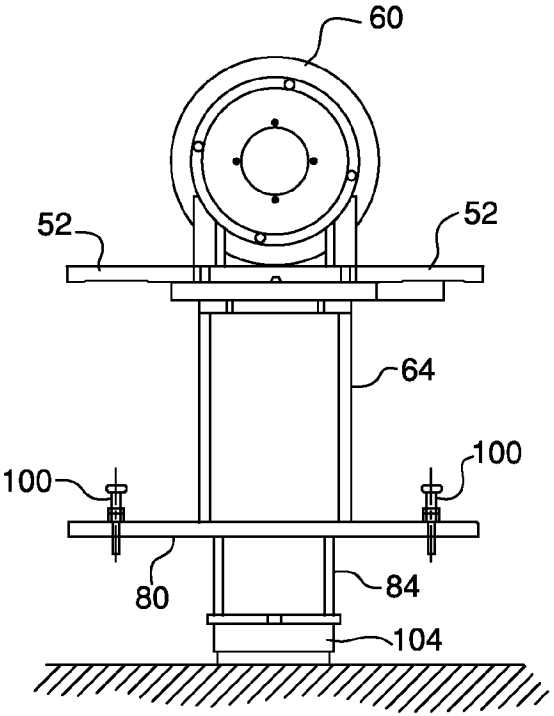
FIG. 2B is a front view thereof.

As best shown in FIGS. 2B and 2D, pedestal 64 includes one or more plates 80, and a floor support 84. Plate(s) 80 should extend generally parallel to the mounting surface and may be adapted to fasten bridge turret transfer assembly 14 to fixed bases 12*a* and 12*b*. Accordingly, plate 80 preferably defines a plurality of plate mounting holes 88. As can be seen in FIG. 1, one side of plate 80 is attached to first fixed base 12*a*, and the opposite side of plate 80 is attached to second fixed base 12*b*. As shown in FIGS. 2A-2D, plate 80 may be fastened to fixed bases 12*a* and 12*b* using bolts 100. Other coupling mechanisms other than bolts 100 may be used, such as, screws, rivets, or any other coupling mechanism known in the art.

As shown in FIG. 2B, floor support 84 preferably includes a vibration damper 104, which may provide structural support for pedestal 64 and may help dampen vibration during operation of bridge turret transfer assembly 14. Any vibration isolation device or dampening pad known in the art may be used.

Figure 3:
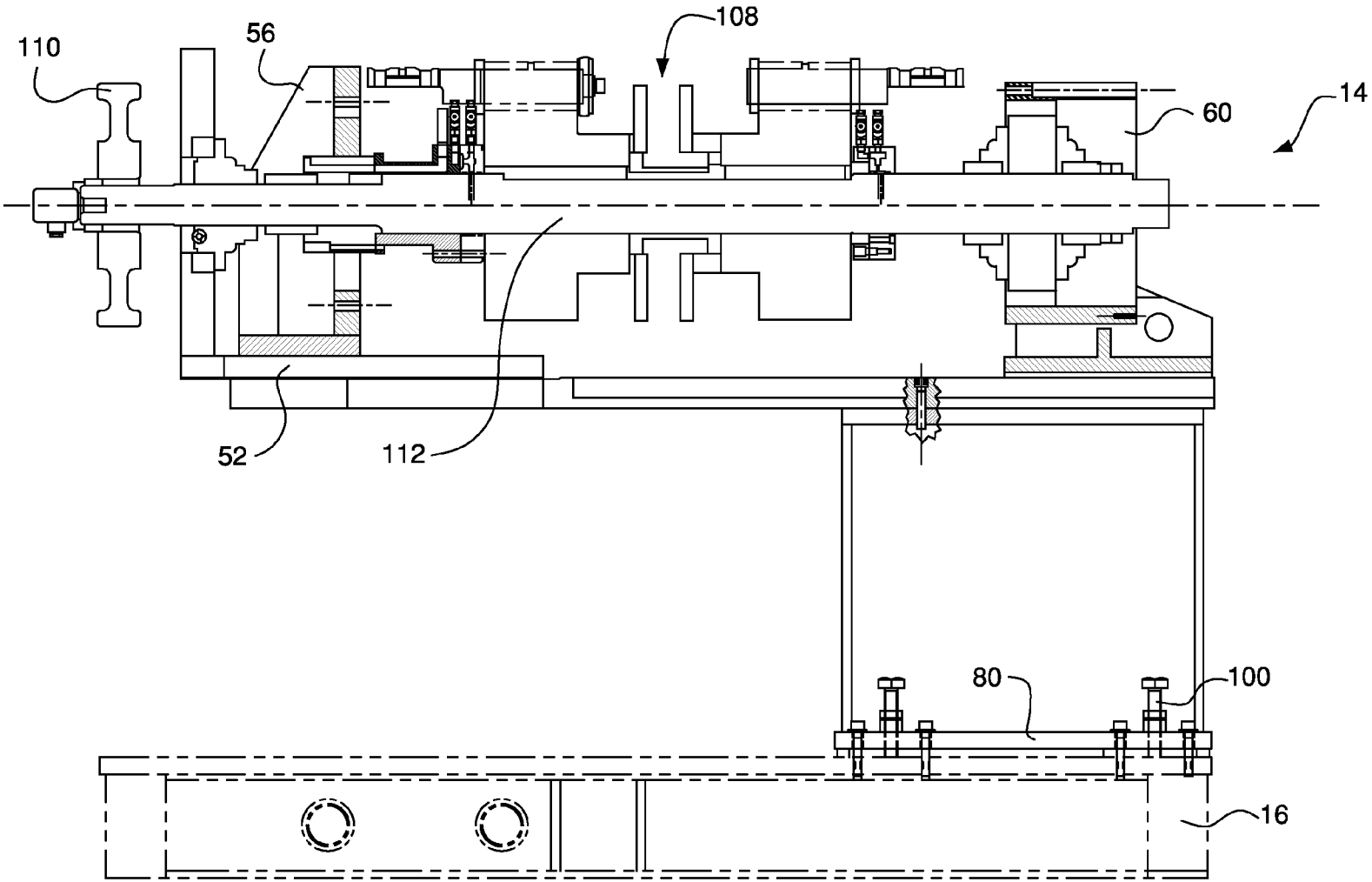
FIG. 3 is a cross-sectional side view depicting a bridge turret transfer assembly including the turret and shaft.

FIG. 3 is a cross-sectional side view depicting a bridge turret transfer assembly including necking stage 34 in more detail. Referring to FIG. 3, necking stage 34 of bridge turret transfer assembly 14 includes a turret 108 with tooling, a gear 110 and a shaft 112.

As shown, turret 108 is attached to shaft 112, and shaft 112 rotates on bearings that are coupled to base 30 at first shaft support 56 and second shaft support 60. Turret 108 may have a plurality of pockets formed therein (not shown). Each pocket may be adapted to receive a can body and securely hold the can body in place by mechanical means and compressed air, as is understood in the art. Using techniques well known in the art of can making, an open end of the can body may be brought into contact with a die by a pusher ram as turret 108 carries the can body through an arc along a top portion of the can necking stage 34 included in bridge turret transfer assembly 14.

As shown, gear 110 may be attached to an end of shaft 112 and may be exterior to first shaft support 56. Though not shown, gear 110 meshes with gears from fixed bases 12*a* and 12*b* to form a continuous gear train along the length of the system 10 when bridge turret transfer assembly has been installed. It should be understood that necking stages 18 may be substantially similar as necking stage 34. That is, necking stages 18 may each look and operate in a similar manner as necking stage 34.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the present invention as defined by the appended claims.

What is claimed:

1. A multi-stage can necking system comprising:

a first fixed base comprising at least two can necking stages and a first starwheel;

a second fixed base comprising at least one can necking stage and a second starwheel; and a bridge turret transfer assembly including a base plate that is coupled to a top surface of a base of at least one of the first fixed base and the second fixed base, the bridge turret transfer assembly is configured to transfer a can body from the first fixed base to the second fixed base such that an end diameter of the can body is reduced as the can body is transferred by the bridge turret transfer assembly, wherein a distance measured between the first starwheel of the first fixed base and the second starwheel of the second fixed base is no more than 27.25 in, and a distance measured from an edge of a base of the first fixed base to an edge of a base of the second fixed base is no more than 27 in after the bridge turret transfer assembly has been coupled to the first fixed base and to the second fixed base.

2. The multi-stage can necking system of claim 1, wherein the at least two necking stages of the first fixed base are each configured to reduce an end diameter of a can body.

3. The multi-stage can necking system of claim 1, wherein the at least one can necking stage of the second fixed base is configured to reform a base of a can body.

4. The multi-stage can necking system of claim 1, wherein the bridge turret transfer assembly further includes a base, a shaft mounted on the base, and a turret mounted on the shaft.

5. The multi-stage can necking system of claim 4, wherein (i) the base comprises a middle support, a pedestal extending down from the middle support, a first wing support extending from the middle support and toward the first fixed base, and a second wing support extending from the middle support and toward the second fixed base, and (ii) the first wing support is configured to be coupled to the first fixed base and the second wing support is configured to be coupled to the second fixed base.

6. The multi-stage can necking system of claim 5, wherein the first wing support is configured to support the first transfer starwheel and the second wing support is configured to support the second transfer starwheel when the bridge turret transfer assembly is coupled to both the first fixed base and the second fixed base.

7. The multi-stage can necking system of claim 1, wherein the bridge turret transfer assembly further includes a vibration damper.

8. A multi-stage can necking system comprising:

a first fixed base comprising a base and at least two can necking stages, each can necking stage having a turret;

a second fixed base comprising a base and at least one can necking stage, each can necking stage having a turret; and a bridge turret transfer assembly that couples the first fixed base and the second fixed base together, the bridge turret transfer assembly includes a base having a middle support, a pedestal extending down from the middle support, a first wing support that extends from the middle support toward the first fixed base, and a second wing support that extends from the middle support toward the second fixed base, the pedestal having a plate that is coupled to a top surface of the base of at least one of the first fixed base and the second fixed base, wherein the bridge turret transfer assembly is configured to transfer a can body from the first fixed base to the second fixed base such that an end diameter of the can body is reduced as the can body is transferred by the bridge turret transfer assembly.

9. The multi-stage can necking system of claim 8, wherein the bridge turret transfer assembly further includes a shaft mounted on the base, and a turret mounted on the shaft.

10. The bridge turret transfer assembly of claim 8, wherein a recess is defined between the first and second wing supports.

11. The multi-stage can necking system of claim 8, wherein the pedestal comprises a first plate that extends toward and couples to a first base of the first fixed base, and a second plate that extends toward and couples to a second base of the second fixed base.

12. The multi-stage can necking system of claim 8, wherein the bridge turret transfer assembly further includes a vibration damper that is configured to provide structural support for the pedestal.

* * * * *